US010961757B2

(12) United States Patent
Barchine

(10) Patent No.: US 10,961,757 B2
(45) Date of Patent: Mar. 30, 2021

(54) DEVICE FOR REPAIRING AND REINFORCING PIVOT PIN SUPPORT FOR DOORS AND RELATED METHODS

(71) Applicant: Alejandro Barchine, Miami Beach, FL (US)

(72) Inventor: Alejandro Barchine, Miami Beach, FL (US)

( * ) Notice: Subject to any disclaimer, the term of this patent is extended or adjusted under 35 U.S.C. 154(b) by 0 days.

(21) Appl. No.: 16/503,590

(22) Filed: Jul. 4, 2019

(65) Prior Publication Data

US 2020/0011108 A1 Jan. 9, 2020

Related U.S. Application Data

(60) Provisional application No. 62/695,027, filed on Jul. 7, 2018.

(51) Int. Cl.
*E05D 15/26* (2006.01)

(52) U.S. Cl.
CPC ..... *E05D 15/264* (2013.01); *E05Y 2900/132* (2013.01)

(58) Field of Classification Search
CPC . Y10T 16/527; Y10T 16/5275; Y10T 16/554; E05D 15/264; E05Y 2900/132
USPC ..... 248/216.1, 217.3; 16/378, 379
See application file for complete search history.

(56) References Cited

U.S. PATENT DOCUMENTS 1,065,068 A * 6/1913 Newell ..... F16B 15/04 248/216.1
1,651,392 A * 12/1927 Honigbaum ..... A47G 1/22 52/548
1,691,179 A * 11/1928 Betz ..... E04F 19/06 52/467
2,371,210 A * 3/1945 Atkinson ..... H02G 3/123 248/27.1
2,602,936 A * 7/1952 Erickson ..... A47K 3/16 248/217.3
2,603,818 A * 7/1952 Carlson ..... E05D 7/081 16/55
3,285,324 A * 11/1966 Stein ..... E05D 7/0027 160/206
3,447,823 A * 6/1969 Gregoire ..... E04D 3/3607 52/714
4,125,078 A * 11/1978 Nyquist ..... A47B 61/00 108/29
4,359,849 A * 11/1982 Goeman ..... E04F 13/0801 52/309.4
4,524,701 A * 6/1985 Chappell ..... A47B 31/06 108/44
4,799,529 A * 1/1989 McAfee ..... E06B 3/9636 160/201
4,925,141 A * 5/1990 Classen ..... E04B 1/2612 248/217.2
5,048,788 A * 9/1991 Lorincz ..... F16B 15/003 248/477
5,076,626 A * 12/1991 Tiddy ..... E05B 15/02 292/1

(Continued)

*Primary Examiner* — Kimberly T Wood
(74) *Attorney, Agent, or Firm* — Franco S. De LiGuori; DP IP Group

(57) ABSTRACT

A device for repairing and reinforcing a pivot pin support of a door panel. The device has bracket and a tubular post extending upwardly from a surface of the bracket. The bracket has a through-hole and the tubular post has a bore concentric with the through-hole.

8 Claims, 7 Drawing Sheets

(56) References Cited

U.S. PATENT DOCUMENTS

| | | | | |
|---|---|---|---|---|
| 5,490,305 | A * | 2/1996 | Domingo Ribot | E05D 7/1011 16/229 |
| 5,519,977 | A * | 5/1996 | Callahan | F16L 3/24 52/712 |
| 5,553,352 | A * | 9/1996 | Bolton | E05D 7/1005 16/229 |
| 5,732,793 | A * | 3/1998 | Dech | A01M 31/02 182/187 |
| 6,418,590 | B1 * | 7/2002 | Nipper | E05D 15/264 16/229 |
| 6,807,780 | B2 * | 10/2004 | McCahill | E04C 3/02 248/300 |
| 6,907,641 | B1 * | 6/2005 | Liles | E05D 15/066 16/221 |
| 7,225,590 | B1 * | 6/2007 | diGirolamo | E04B 1/4178 52/379 |
| 8,356,387 | B1 * | 1/2013 | Mattix | E05D 7/0027 16/382 |
| 8,505,168 | B1 * | 8/2013 | Chapman | E05D 11/00 16/223 |
| 8,506,026 | B2 * | 8/2013 | Kim | F25D 23/028 312/405 |
| 8,667,765 | B1 * | 3/2014 | McCarthy | E04F 13/0841 248/301 |
| 2019/0383072 | A1 * | 12/2019 | Rodriguez Rodriguez | F16C 11/04 |

* cited by examiner

DEVICE FOR REPAIRING AND REINFORCING PIVOT PIN SUPPORT FOR DOORS AND RELATED METHODS

RELATED APPLICATION

This application claims the benefit of U.S. Provisional Patent Application No. 62/695,027, filed on Jul. 7, 2018.

TECHNICAL FIELD

The present disclosure relates generally to doors and, more particularly, to a device for repairing and reinforcing pivot pin supports for doors, such as bi-fold doors, and to related methods thereof.

BACKGROUND

Bi-fold doors are a set of doors hinged together that fold into each other, are mounted and hung from a track, and include pivots at the top and bottom for effecting opening and closing operations. Bi-fold doors are most commonly found in areas like closets, laundry rooms and the kitchen pantry. These doors are relatively easy to install, economical and take less space than a traditional swinging door. Typical bi-fold doors are not commonly made of solid wood, especially the cost-effective ones. These doors have a hollow core and are usually made of a material comprised of sawdust and glue packed together. This packed material holds all of the hardware and components for the bi-fold doors and, as such, can be damaged over time.

For example, when bi-fold doors are slammed open with force a sufficient number of times, as commonly happens during use, the hole for the pivot pin in the door will become oversized, causing the pin to tilt and pop out, rendering the bi-fold door inoperative. In many instances, the force is sufficient such that the wood around the pivot hole becomes oversized or is broken out. If the damage is significant, the only way to repair the problem is to replace the bi-fold door, which is a labor intensive, expensive, time consuming undertaking. Furthermore, many available repair options that do not require replacement of the bi-fold door are expensive, cumbersome and typically require repair off-site.

In view of the foregoing, there is a need for a device for repairing and reinforcing pivot pin supports for doors, such as bi-fold doors, and related methods thereof, which overcome the foregoing drawbacks of the conventional art.

SUMMARY

In view of the foregoing, it is an object of the present disclosure to provide a device for repairing and reinforcing a pivot pin support, e.g., pivot holes, for doors, such as bi-fold doors, which is economical to manufacture and which can address the foregoing problems in the conventional art with high efficiency and at minimal cost in both material and labor.

Another object of the present disclosure to provide a repair/reinforcement device for door pivot pin supports that will eliminate the need to find matching doors or matching hardware, avoid all of the fitting and paint matching tasks, and save a great deal of time and expense in the process.

It is yet another object of the present disclosure to provide a repair/reinforcement device for door pivot pin supports that can be installed on-site.

Other objects and features of the present disclosure will be in part apparent and in part pointed out hereinafter.

In one aspect, the present disclosure provides a repair and reinforcement device for a pivot pin support of a door, such as a bi-fold door. The device comprises a generally plate-shaped bracket having a through-hole, and a tubular post extending upwardly from a surface of the bracket, the tubular post having a bore concentric with the through-hole.

In one embodiment, a plurality of nail teeth are provided on the surface of the bracket along opposite side edges thereof so as to extend upwardly therefrom in the extension direction of the tubular post.

In another embodiment, a plurality of tabs are provided along opposite longitudinal sides of the bracket so as to extend upwardly from the surface thereof in the extension direction of the tubular post.

In yet another embodiment, the device further comprises a tubular sleeve configured to be received by the concentric through-hole of the bracket and bore of the tubular post.

In still another embodiment, the bracket, tubular post and/or tubular sleeve are made of a plastic material, such as ABS (acrylonitrile butadiene styrene) plastic. In an alternative embodiment, the bracket, tubular post and/or tubular sleeve are made of metal.

In another aspect, the present disclosure is directed to the combination of a door panel having a pivot pin support, and a device according to any of the embodiments in the present disclosure for repairing and reinforcing the pivot pin support. In an embodiment, the door panel is a bi-fold door panel.

BRIEF DESCRIPTION OF THE DRAWINGS

The foregoing summary, as well as the following detailed description of preferred embodiments of the disclosure, will be better understood when read in conjunction with the accompanying drawings. For the purpose of illustrating the disclosure, there is shown in the drawings embodiments which are presently preferred. It should be understood, however, that the disclosure is not limited to the precise arrangement and instrumentalities shown.

DETAILED DESCRIPTION

Figure 1:
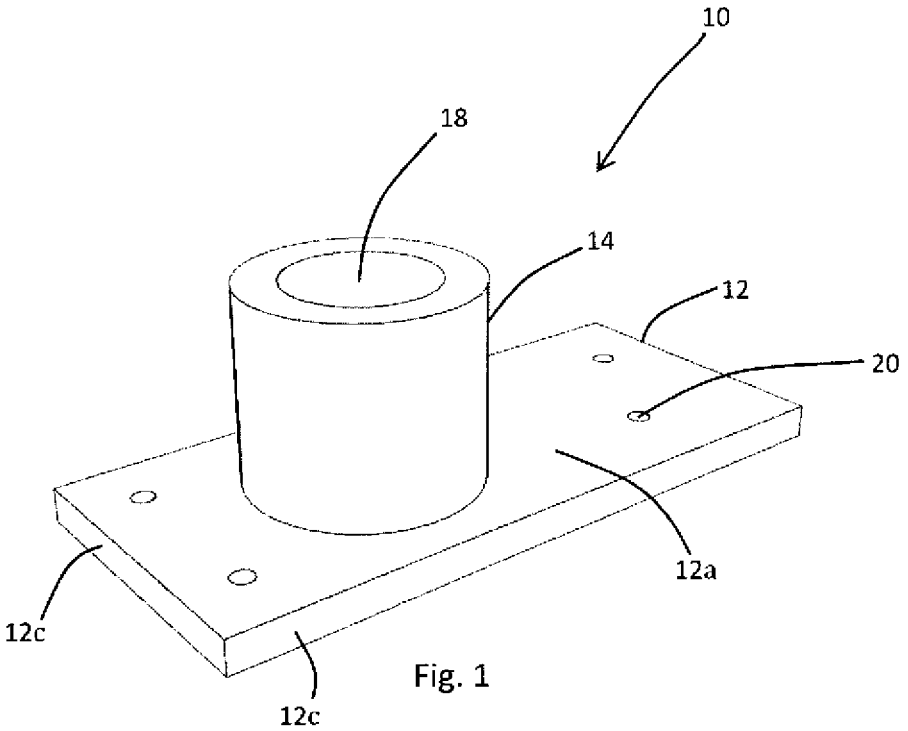
FIG. 1 is a perspective view of a device for repairing and reinforcing a pivot pin support for doors, such as bi-fold doors, according to an embodiment of the present disclosure.
Figure 2:
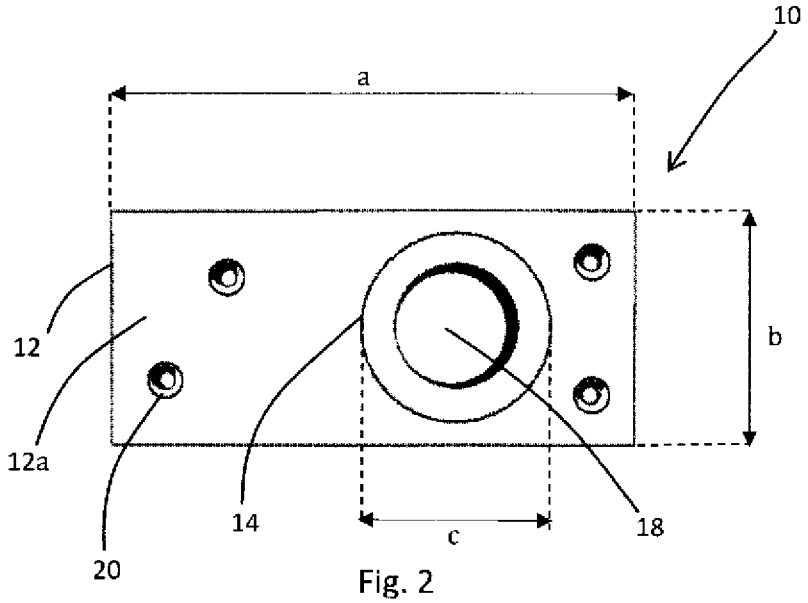
FIG. 2 is a top view of the device shown in FIG. 1.
Figure 3:
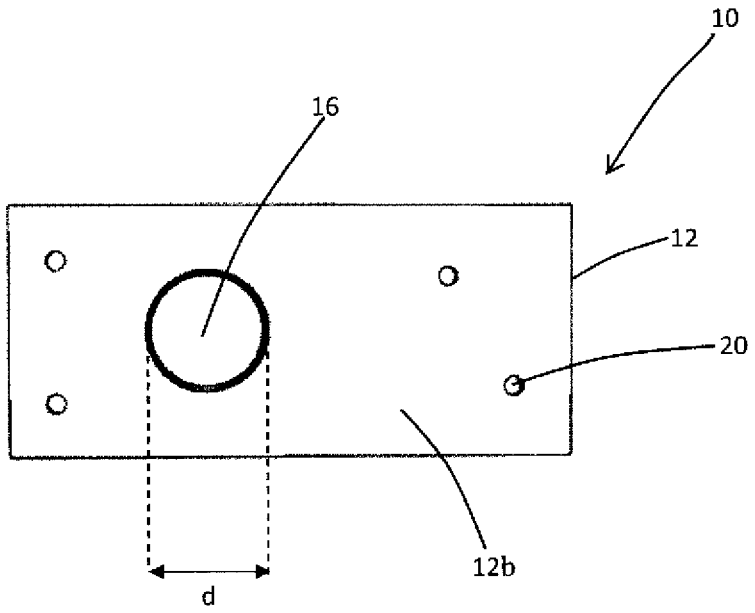
FIG. 3 is a bottom view of the device shown in FIG. 1.
Figure 4:
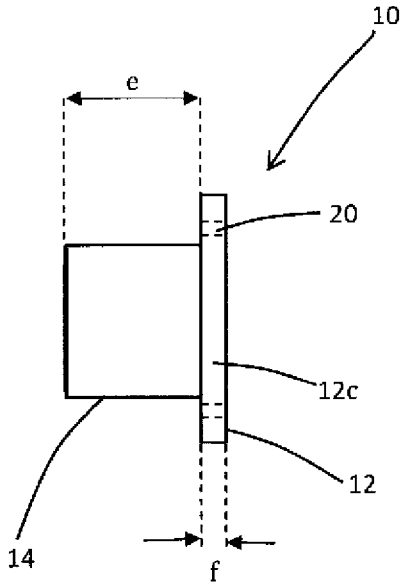
FIG. 4 is a side view of the device shown in FIG. 1.

The present disclosure now will be described more fully hereinafter with reference to the accompanying drawings, in which exemplary embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art.

For convenience of description, the terms "front", "back", "upper", "lower", "top", "bottom", "front", "rear", "right", "left", "side" and words of similar import will have reference to the various members and components of the shapewear garment of the present disclosure as arranged and illustrated in the figures of the drawings and described hereinafter in detail.

It should also be understood that the terms "about," "approximately," "generally," "substantially" and like terms, used herein when referring to a dimension or characteristic of a component of the present disclosure, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIGS. 1-10 more particularly by reference character, reference numeral 10 generally designates a device for repairing and reinforcing a pivot pin support for a panel (e.g., a pivot panel) of a door, such as a bi-fold door. Although the present disclosure is described herein with a particular application to pivot pin supports for bi-fold doors, it will be appreciated that the devices according to the embodiments of the present disclosures are also suitable for repairing and reinforcing pivot pin supports for pivot panels other than pivot panels for bi-fold doors. Furthermore, the devices according to the embodiments of the present disclosure are also suitable for repairing and reinforcing pivot pin supports located at the top and bottom of pivot panels.

FIGS. 1-4 show the structural configuration and features of device 10, and FIGS. 5-10 show device 10 in the assembled state and during the various assembly steps for repairing a pivot pin support of a typical bi-fold door panel generally designated at 11. As shown in FIGS. 5-7, 9 and 10, device 10 is configured for attachment to a corner region 13 located at the top or bottom of door panel 11 containing a damaged portion generally designated at 15.

Figure 9:
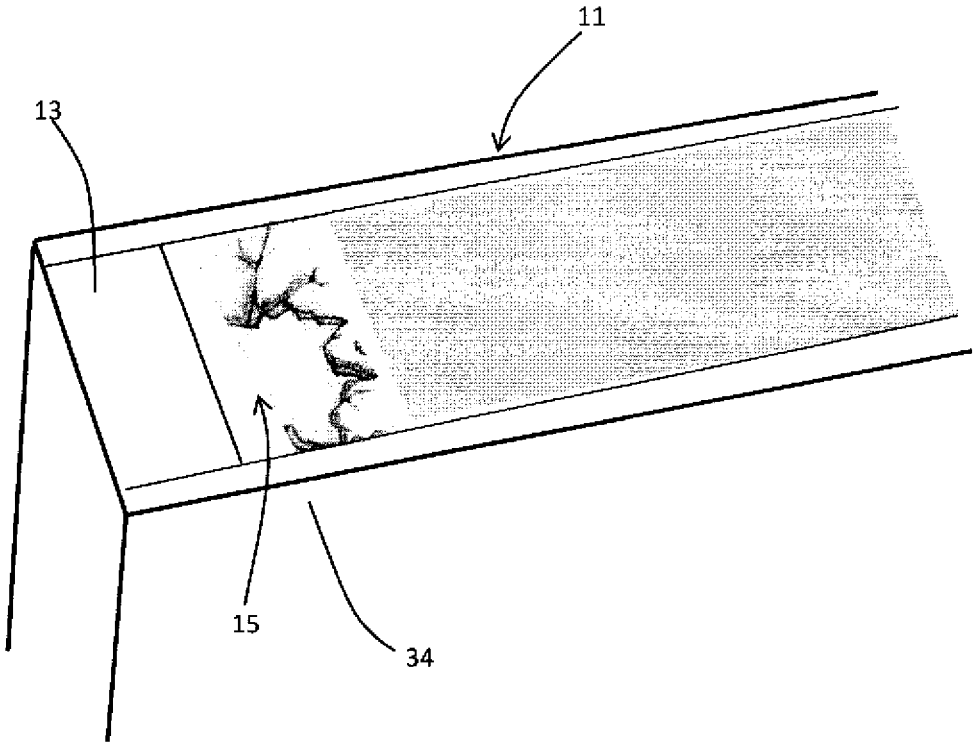
FIG. 9 is a perspective top view showing details of a corner of a damaged door which is repaired using the device of the present disclosure.

One primary object of device 10 according to the present disclosure is to repair door panel 11 when the door panel is damaged (e.g., split open) as denoted at 15 of corner region 13 in FIG. 9 in which case door panel 11 is most likely not usable. It is understood that door panel 11 does not form part of the inventive aspects of the present disclosure but is shown in the drawings to clarify the suggested use of device 10.

Device 10 primarily comprises a strap or bracket 12 and a vertical tubular post 14. Bracket 12 has front and rear surfaces 12*a*, 12*b* and side surfaces 12*c*. Tubular post 14 has a longitudinal bore 18 and extends upwardly from and is generally perpendicular to front surface 12*a* of bracket 12. Bracket 12 has a through-hole 16 extending from front surface 12*a* to rear surface 12*b* and positioned so as to be concentric and in full communication with bore 18 of tubular post 14. Bracket 12 is provided with openings 20 (four openings shown in the figures as an example only) extending from front surface 12*a* to rear surface 12*b* configured to receive suitable fasteners (e.g., screws) for fastening bracket 12 to corner region 13 of door 11.

Figure 7:
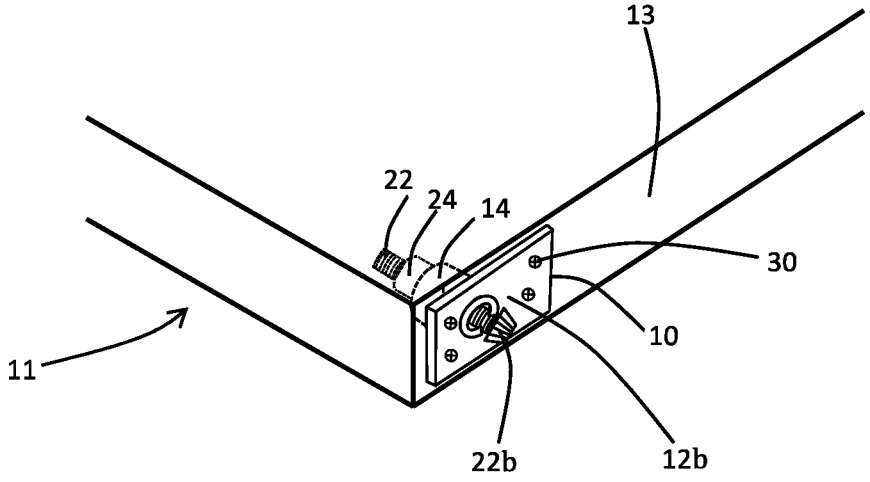
FIG. 7 is a perspective view showing the device of the present disclosure in an assembled state relative to a damaged door to be repaired.
Figure 8:
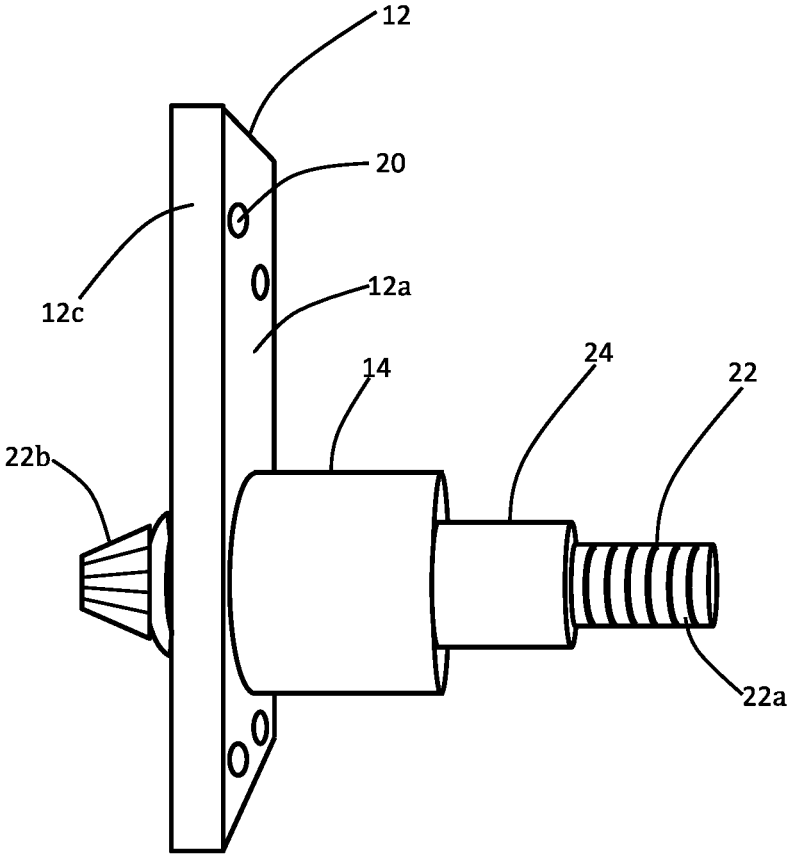
FIG. 8 is a partial perspective side view of the device of the present disclosure showing a standard pivot pin in an assembled state relative to the device.

As shown in FIGS. 7-8, bore 18 of tubular post 14 is configured to receive a pivot pin 22 and corresponding sleeve 24. Tubular post 14 is positioned on surface 12*a* of bracket 12 so that bore 18 is located to align approximately with an opening/hole of door panel 11 in the damaged region 15 when device 10 is mounted to door panel 11. Pivot pin 22 has a male thread for threaded engagement with a female thread (not shown) of sleeve 24. Pivot pin 22 and sleeve 24 are commercially available and do not form part of the inventive aspects of the present disclosure but is shown in the drawings to clarify the suggested use of device 10.

In the present embodiment, device 10 is of unitary construction, i.e., it is made out of a single continuous piece of material. Stated otherwise, tubular post 14 is integrated with bracket 12. In an alternative embodiment, tubular post 14 may comprise a tubular member removably mounted, such as by suitable fasteners (e.g., screws) or an adhesive, to front surface 12*a* of bracket 12.

Device 10, including bracket 12 and tubular post 14, may be formed of a plastic material by an injection molding process. For example, device 10 can be made of ABS (acrylonitrile butadiene styrene) plastic. Alternatively, device 10 may be formed of metal using a suitable machining process.

In the embodiment shown in FIGS. 1-10, bracket 12 has a generally rectangular plate shape and tubular post 14 is generally cylindrical-shaped. It is understood, however, that the bracket 12 and tubular post 14 are not limited to the specific configurations, including shapes, shown in FIGS. 1-10. For example, bracket 12 may be configured with a plate shape other than rectangular, such as oval or square, and the exterior surface of tubular post 14 may be configured with a shape other than cylindrical, such as rectangular or square, without departing from the spirit and scope of the present disclosure.

The dimensions for the various components of device 10 are selected to effectuate the corresponding repair/reinforcement functions of device according to the present disclosure. In this regard: bracket 12 has length a, width b and thickness f, and through-hole 16 of bracket 12 has diameter d; and tubular part 18 has outer diameter c, and height e. In an exemplary embodiment, dimension a is about 2⅜ inches, dimension b is about 1 1/16 inches, dimension c is about ¾ inch, dimension d is about ½ inch, dimension e is about ⅝ inch, and dimension f is about ⅛ inch. It is understood, however, that the specific dimensions for the various components of device 10 are selected to accommodate the corresponding dimensions of the bi-fold door to be repaired/reinforced.

It will be appreciated that the construction of device 10 as described above provides both stability and support for the door panel 11 and corresponding pivot pin 22/sleeve 24 unit. Specifically, when device 10 is assembled to door panel 11, bracket 12 defines a base providing support to corner region 13 (including damaged portion 15) to which it is securely attached as described herein, and tubular post 14 provides the requisite stability to the pivot pin 22/sleeve 24 unit. As such, device 10 comprises a structural integrity arrangement to repair/reinforce a damaged bi-fold door panel.

A method of assembling device 10 on a bi-fold door panel 11 for repairing and reinforcing door panel 11 according to the present disclosure is described below with reference to FIGS. 1-10. Prior to repair/reinforcement, bi-fold door panel 11 is first taken down from its location of use.

Figure 5:
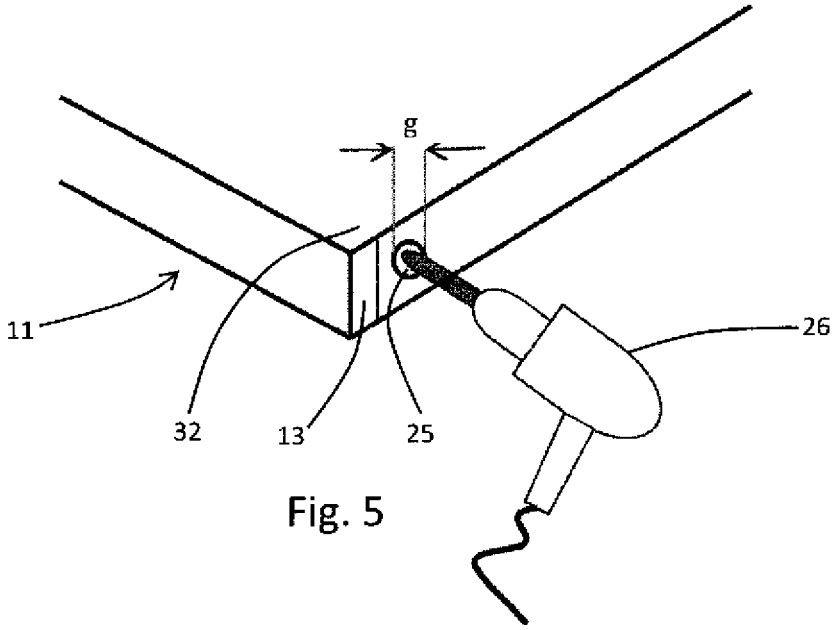
FIG. 5 is a perspective view showing an optional preliminary step in a method of repairing and reinforcing a pivot pin support for according to an embodiment of the present disclosure.
Figure 6:
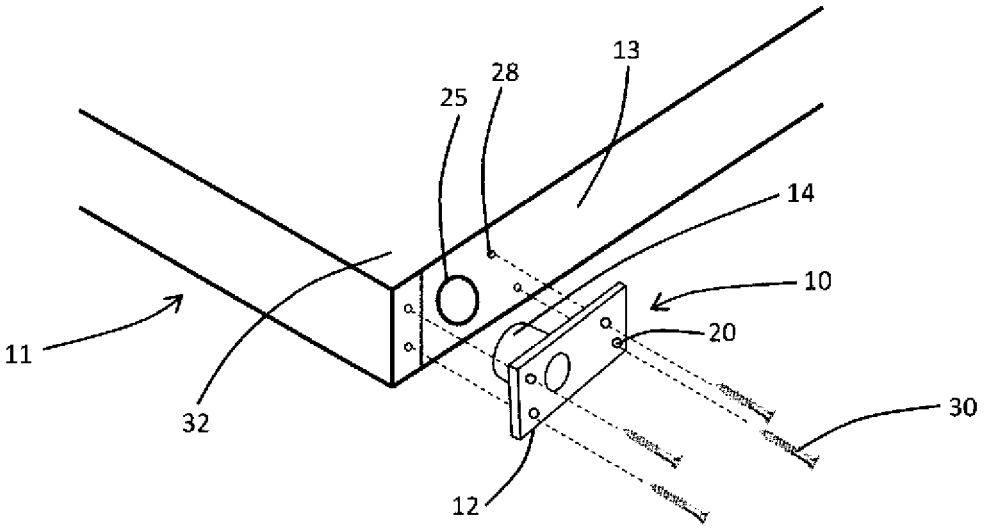
FIG. 6 is a perspective view showing a step in the method of repairing and reinforcing a pivot pin support for doors according to an embodiment of the present disclosure.
Figure 10:
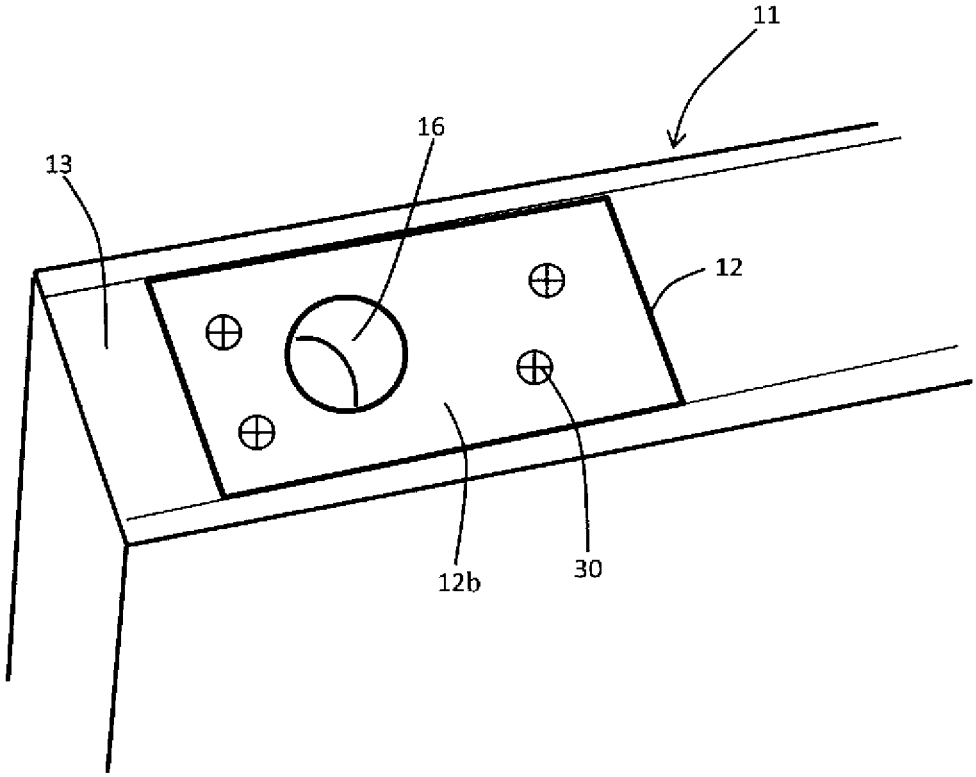
FIG. 10 is a perspective top view similar to FIG. 9, but with the device of the present disclosure shown in an installed state relative to the damaged door.

FIG. 5 is a perspective view showing an optional preliminary step in the repair/reinforcement method using device 10. A hole 25 is drilled, if necessary, in corner region 13 using a drill 26, for example, in order to expand damaged region 15 of door panel 11. Hole 25 is preferably drilled to a diameter g corresponding to diameter c (FIG. 2) of tubular post 14. Holes 28 (e.g., four holes 28 corresponding to four holes 20 in bracket 12) are also drilled into corner region 13 of door panel 11. Device 10 is then mounted on the surface of corner region 13 of door panel 11 by inserting tubular post 14 inside hole 25 as shown in FIGS. 6, 7 and 10, or into an opening in damaged region 15 of corner region 13 if formation of hole 25 is not necessary. Device 10 is then secured to corner region 13 of door panel 11 by passing fasteners (e.g., screws) 30 through openings 20 in bracket 12 and into corresponding holes 28 in corner region 13. FIG. 10 is a top perspective view showing device 10 in the assembled state relative to door panel 11.

It will be appreciated that the means for securing device 10 to corner region 13 of door panel 11 is not limited to holes 20 in bracket 12, holes 25 in corner region 13 and fasteners 30. In an alternative embodiment, for example, device 10 can be secured to corner region 13 using a suitable high-strength adhesive that is applied to portions of front surface 12*a* of bracket 12 and/or corresponding surface portions of corner region 13. Other means for securing device 10 to corner region 13 are suitable without departing from the spirit and scope of the present disclosure.

After device 10 is securely mounted to door panel 11 as set forth above, pivot pin 22 and sleeve 24, already pre-assembled as one unit (i.e., by threading engagement), are mounted to device 10 by inserting end 22*a* of pivot pin 22 and sleeve 24 into through-hole 16 of bracket 12 and bore 18 of tubular post 14, as shown in FIG. 7. In this embodiment, pivot pin 22 and sleeve 24 are securely mounted to device 10 by direct engagement between an outer surface of sleeve 24 and inner surfaces of through-hole 16 and bore 18. Stated otherwise, sleeve 24 (which is integrated with pivot pin 22) securely engages inner surfaces of through-hole 16 and bore 18 with a friction-fit. It is understood, however, that alternative securing means may be provided between pivot pin 22/sleeve 24 and device 10 without departing from the spirit and scope of the present disclosure.

In an alternative embodiment, pivot pin 22 and sleeve 24 may be securely mounted to device 10, i.e., pre-assembled together, as described above prior to assembling device on door panel 11. FIG. 8 shows device 10 pre-assembled with pivot pin 22/sleeve 24 as a single unit prior to being securely mounted to door panel 11. This single unit is then securely mounted to door panel 11 by inserting end 22*a* of pivot pin 22 and sleeve 24 into through-hole 16 of bracket 12 and bore 18 of tubular post 14 to obtain the configuration described above with reference to FIG. 7.

After device 10 and pivot pin 22/sleeve 24 are securely mounted to door panel 11 as described above, panel door 11 is reinstalled at its location of use. During reinstallation, pivot pin 22 is adjusted, as necessary, to vary the distance of corner region 13 of door panel 11 relative to a fixed structure (e.g., the floor) by turning head portion 22*b* to vary the threaded engagement between pivot pin 22 and sleeve 24. It will be appreciated that while installation of device 10 and pivot pin 22/sleeve 24 requires unhanging door panel 11, device 10 and pivot pin 22/sleeve 24 can be assembled to door panel 11 without taking door panel 11 off-site for repair/reinforcement.

By the foregoing configuration and corresponding assembly method, it will be appreciated that device 10 can be used for repairing and/or reinforcing a bi-fold door panel from damage as described above, with high efficiency and at minimal cost in material and labor.

Figure 11:
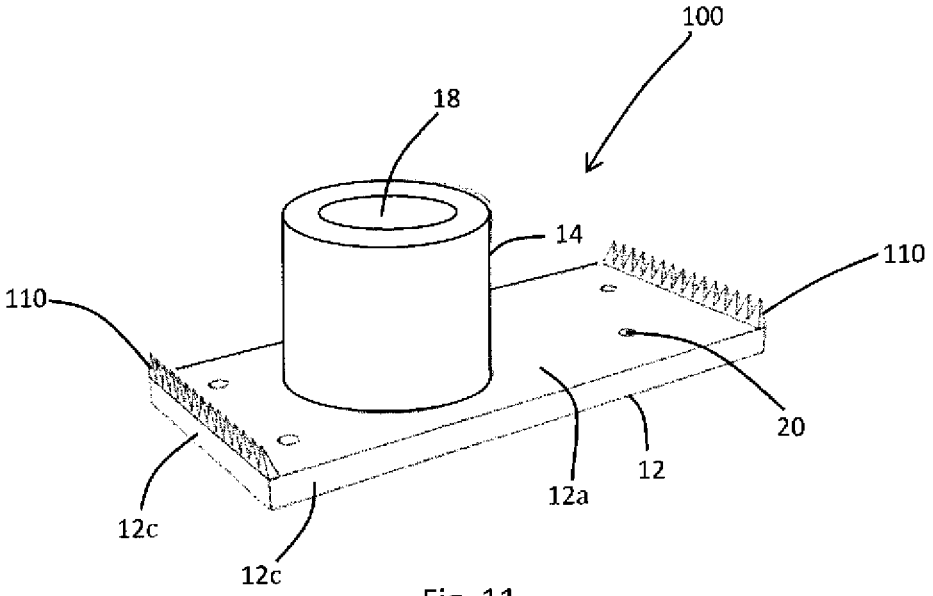
FIG. 11 is a perspective view of a device according to another embodiment of the present disclosure.

FIG. 11 shows another embodiment of a device, generally designated at 100, for repairing and reinforcing a pivot pin support for a bi-fold door panel. The features and advantages of device 100 are the same as described above for device 10, except for the following additional features and advantages.

Device 100 differs from device 10 in that device 100 is further provided with serrations or nail teeth 110 on front surface 12*a* along opposite side edges of bracket 12 so as to extend upwardly from front surface 12*a*, as shown in FIG. 11. The function of nail teeth 110 is to stabilize device 100 on corner region 13 of door panel 11 during the assembly process described above with reference to device 10. Nail teeth 110 also function to further secure device 100 to corner region 13 of door panel 11 after device 100 is assembled to door panel 11. Nail teeth 110 may be formed during the fabrication of device 100 utilizing, for example, a suitable injection molding process or machining process, depending on the material selected for fabrication of device 100.

During installation of device 100, tubular post 14 is inserted in hole 25 of door panel 11, or into an opening in damaged region 15 of corner region 13 if formation of hole 25 is not necessary, as described above for the embodiment of device 10 until nail teeth 110 contact the surface of corner region 13 surrounding hole 25. At this point, bracket 12 is pressed against corner region 13 of door panel 11 so that nail teeth 110 are embedded into the surface of corner region 13. A manual pressing force may be sufficient to embed nail teeth 110 into the surface of support corner region 13 depending on the hardness of the material of corner region 13. Alternatively, this pressing force can be achieved using a suitable hammer tool by hammering device 10 from rear surface 12*b* of bracket 12 while device 100 is positioned relative to door panel 11 as described above. Device 100 is then secured to corner region 13 and the pre-assembled pivot pin 22/sleeve 24 unit is mounted to device 100 as described above for device 10 to complete the installation.

Figure 12:
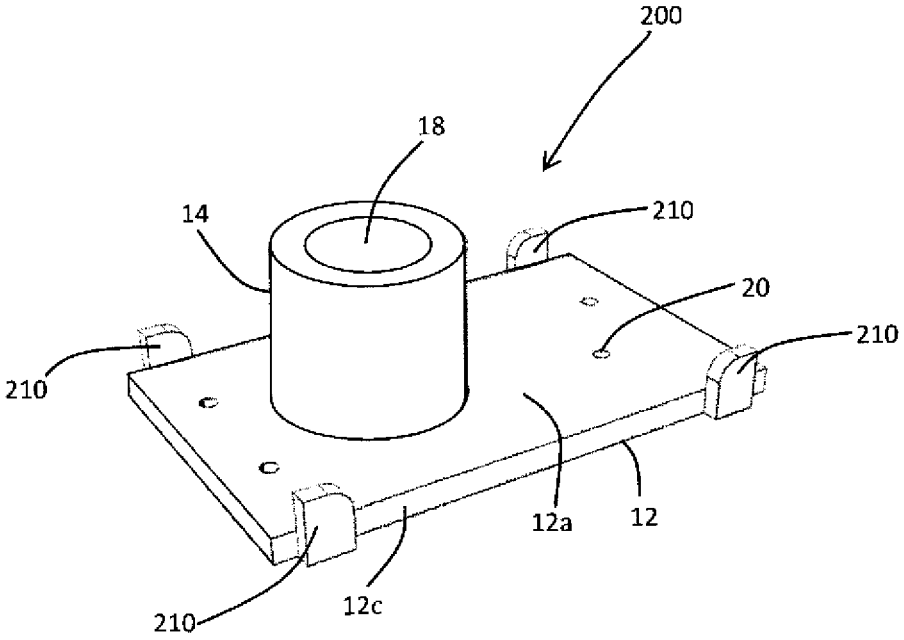
FIG. 12 is a perspective view of a device according to another embodiment of the present disclosure.

FIG. 12 shows another embodiment of a device, generally designated at 200, for repairing and reinforcing a pivot pin support for a bi-fold door panel. The features and advantages of device 200 are the same as described above for device 10, except for the following additional features and advantages.

Device 200 differs from device 10 in that device 200 is further provided with tabs 210 on and along opposite longitudinal sides 12*c* of bracket 12 so as to extend upwardly from front surface 12*a*, as shown in FIG. 12. The function of tabs 210 is to stabilize device 200 on corner region 13 of door panel 11 during the assembly process described above with reference to device 10. Tabs 210 also function to further secure device 200 to corner region 13 of door panel 11 after device 200 is assembled to door panel 11. Tabs 210 may be formed during the fabrication of device 200 utilizing, for example, a suitable injection molding process or machining process, depending on the material selected for fabrication of device 200. Alternatively, tabs 210 may be fabricated separately from device 200 and secured to bracket 12 of device 200 using suitable fastening means (e.g., hardware or adhesive).

During installation of device 200, when tubular post 14 is inserted into hole 25 of door panel 11 as described above, tabs engage (e.g., cradle) respective opposite side surface portions 32, 34 (FIGS. 5, 6, 9) of door panel 11 with a sufficient friction fit so as to hold device 200 in place relative to door panel 11. Device 200 is then secured to corner region 13 and the pre-assembled pivot pin 22/sleeve 24 unit is mounted to device 200 as described above for device 10 to complete the installation.

In the embodiment shown in FIG. 12, device 200 is provided with four tabs, i.e., two on each longitudinal side 12*c* of bracket 12. It is understood, however, that more than two tabs may be provided at each longitudinal side 12*c*, or a single tab extending along a substantial portion of each longitudinal side 12*c* may be provided without departing from the spirit and scope of the invention.

In view of the foregoing, it will be appreciated that nail teeth 110 and tabs 210 provide additional stability to devices 100 and 200, respectively, relative to door panel 11 both during and after the installation process. Nail teeth 110 and tabs 210 also further secure devices 100 and 200, respectively, to corner region 13 of door panel 11 after the corresponding installation process. As such, nail teeth 110 and tabs 210 define means for stabilizing and/or further securing devices 100 and 200, respectively, to door panel 11 both during and after the installation process.

Figure 13:
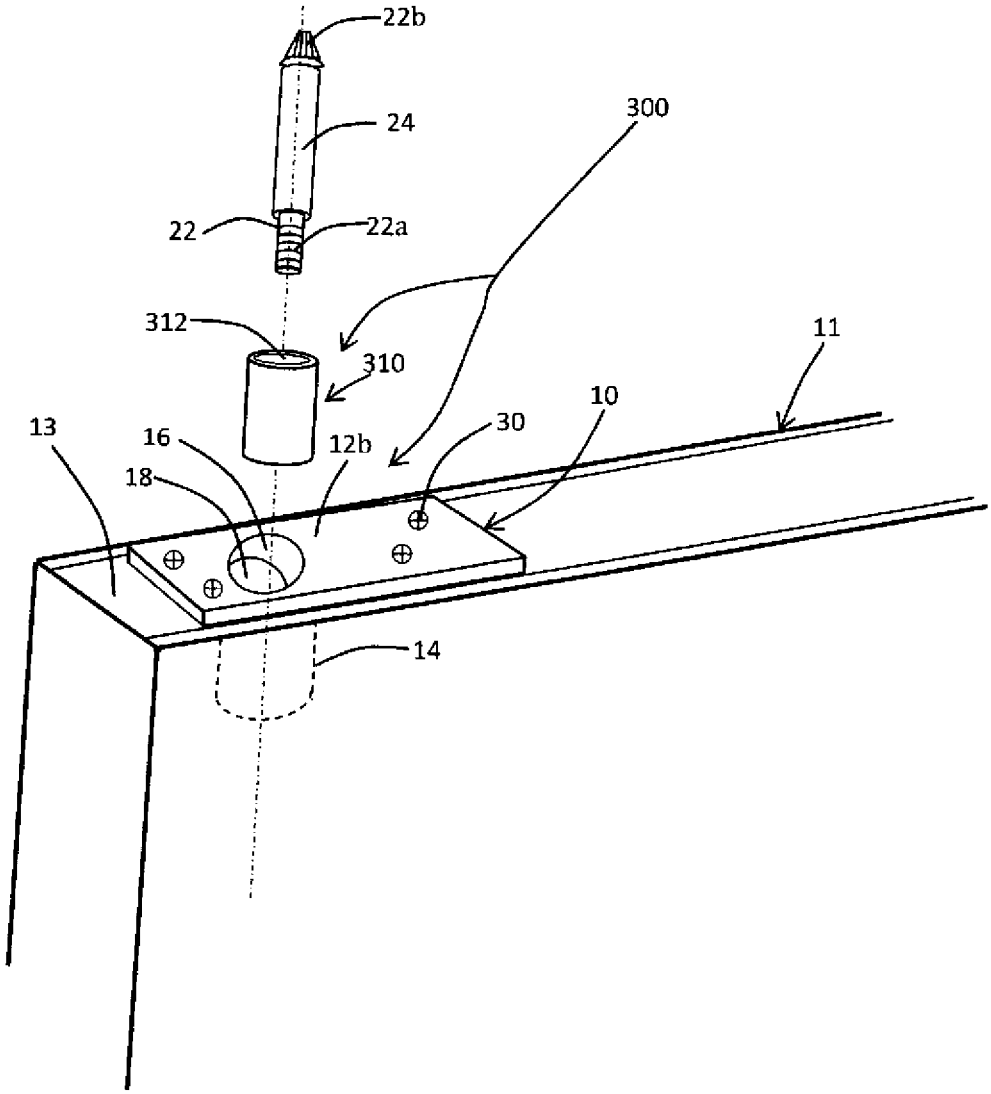
FIG. 13 is a perspective view of another embodiment of the device according to the present disclosure shown in the process of being installed to a damaged door.

FIG. 13 shows another embodiment of a device, generally designated at 300, for repairing and reinforcing a pivot pin support for a bi-fold door panel. The features and advantages of device 300 are the same as described above for device 10, except for the following additional features and advantages.

Device 300 differs from device 10 in that device 300 further includes a tubular sleeve 310 configured to be interposed between bracket 12/tubular post 14 and the pre-assembled pivot pin 22/sleeve 24 unit. The function of sleeve 310 is to eliminate any play between device 300 and the pivot pin 22/sleeve 24 unit when device 300 is assembled to door panel 11.

In this embodiment, sleeve 310 has a bore 312 and is generally cylindrical in construction corresponding to the generally cylindrical construction of tubular post 14. Sleeve 310 is configured to be inserted into through-hole 16 of bracket 12 and bore 18 of tubular post 14 and securely retained therein by friction-fit in the assembled state of device 300. For this purpose, sleeve 310 is provided with an outer diameter that is slightly smaller than the diameter of each of through-hole 16 and bore 18. The pivot pin 22/sleeve 24 unit is configured to be inserted into bore 312 of sleeve 310 and retained therein by friction-fit. For this purpose, sleeve 24 is provided with an outer diameter that is slightly smaller than the diameter of bore 312 of sleeve 310. By this construction, any play between sleeve 24 (and thus pivot pin 22) and bracket 12/tubular post 18 of device 300 can be effectively eliminated when device 300 is assembled to door panel 11.

Sleeve 310 is an element that is separate and independent from bracket 12 and tubular post 14. That is, sleeve 310 is not formed unitarily with bracket 12 and tubular post 14. Sleeve 310 can be fabricated of a suitable plastic material similar to one used for bracket 12 and tubular post 14, such as ABS plastic. Alternatively, bracket 12, tubular post 14 and sleeve 312 of device 300 can be fabricated form a suitable metal material.

In view of the foregoing, it will be seen that the several objects of the invention are achieved and other advantageous results attained. The devices for repairing and reinforcing a pivot pin support, e.g., pivot holes, in bi-fold doors according to the foregoing embodiments are economical to manufacture and address the problems in the conventional art with high efficiency and at minimal cost in both material and labor. These devices provide a repair/reinforcement device for bi-fold doors that will eliminate the need to find matching doors or matching hardware, avoid all of the fitting and paint matching tasks, and save a great deal of time and expense in the process. The devices for repairing and reinforcing pivot pin supports of bi-fold door panels according to the present disclosure can also be installed on-site.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but are to be accorded the widest scope consistent with the principles and novel features disclosed herein.

The invention claimed is:

1. A device for repairing and reinforcing a pivot pin support for a door, the device comprising:

a bracket configured to be securely engaged with a surface portion of the door in which the pivot pin support is provided, the bracket having a through-hole;

a single tubular post extending from a surface portion of the bracket and having a bore concentric with the through-hole, the tubular post being configured for insertion directly into a hole formed in the surface portion of the door while the bracket engages the surface portion;

a tubular sleeve having a bore and being configured to be inserted into and received by the concentric through-hole of the bracket and bore of the tubular post so as to be retained therein by friction-fit in an assembled state of the device; and a pin/sleeve assembly having a pin and a sleeve mounted on the pin, the pin/sleeve assembly being configured to be inserted into and extend directly through the bore of the tubular sleeve so as to be retained directly therein by friction-fit in the assembled state of the device;

wherein in the assembled state of the device, the tubular sleeve is configured to be interposed between the concentric through-hole of the bracket and bore of the tubular post and the pin/sleeve assembly;

wherein the tubular sleeve is an element that is separate and independent from the bracket, the tubular post, and pin/sleeve assembly;

wherein the bracket and tubular post are integrated together as a unitary structure made of a single, continuous piece of material; and wherein the bracket has opposite side edges and a central surface portion disposed between the side edges, and the bore of the tubular post has a central longitudinal axis that is offset from the central surface portion in a direction towards one of the opposite side edges of the bracket.

2. The device according to claim 1, wherein the bracket, tubular post, and tubular sleeve are made of a plastic material.

3. The device according to claim 2, wherein the plastic material comprises ABS (acrylonitrile butadiene styrene) plastic.

4. The device according to claim 1, wherein bracket and tubular post are made of a metal material.

5. The device according to claim 1, further comprising a means for stabilizing and/or further securing the device including a plurality of nail teeth provided on the surface of the bracket along opposite side edges thereof so as to extend upwardly therefrom, the nail teeth being configured to be embedded into the surface portion of the door.

6. The device according to claim 1, further comprising a means for stabilizing and/or further securing the device including a plurality of tabs provided along opposite longitudinal sides of the bracket so as to extend upwardly from the surface thereof, the tabs being configured to engage respective opposite side surface portions of the door.

7. The device according to claim 1, wherein the door comprises a door panel for a bi-fold door.

8. In combination with a door panel having a pivot pin support with a damaged region, a device for repairing and reinforcing the damaged region of the pivot pin support, the device comprising:

a bracket configured to be securely engaged with a surface of the damaged region of the pivot pin support in an assembled state of the device, the bracket having a through-hole;

a single tubular post extending from a surface portion of the bracket and having a bore concentric with the through-hole, the tubular post being configured for insertion directly into a hole formed in the damaged region of the pivot pin support while the bracket engages the surface of the damaged region in the assembled state of the device;

a tubular sleeve having a bore and being configured to be inserted into and received by the concentric through-hole of the bracket and bore of the tubular post so as to be retained therein by friction-fit in the assembled state of the device; and a pin/sleeve assembly having a pin and a sleeve mounted on the pin, the pin/sleeve assembly being configured to be inserted into and extend directly through the bore of the tubular sleeve so as to be retained directly therein by friction-fit in the assembled state of the device;

wherein in the assembled state of the device, the tubular sleeve is configured to be interposed between the concentric through-hole of the bracket and bore of the tubular post and the pin/sleeve assembly;

wherein the tubular sleeve is an element that is separate and independent from the bracket, the tubular post, and pin/sleeve assembly;

wherein the bracket and tubular post are integrated together as a unitary structure made of a single, continuous piece of material; and wherein the bracket has opposite side edges and a central surface portion disposed between the side edges, and the bore of the tubular post has a central longitudinal axis that is offset from the central surface portion in a direction towards one of the opposite side edges of the bracket.

* * * * *